US008059984B2

(12) United States Patent
Lubin et al.

(10) Patent No.: US 8,059,984 B2
(45) Date of Patent: Nov. 15, 2011

(54) CARRIER BEAD COLLECTION ASSEMBLY FOR A XEROGRAPHIC PRINTER

(75) Inventors: Dara Nanette Lubin, Pittsford, NY (US); Amy L. Stamp, Rochester, NY (US); Robert B. Anderson, Jr., Syracuse, NY (US)

(73) Assignee: Xerox Corporation, Norwalk, CT (US)

( * ) Notice: Subject to any disclaimer, the term of this patent is extended or adjusted under 35 U.S.C. 154(b) by 396 days.

(21) Appl. No.: 12/434,834

(22) Filed: May 4, 2009

(65) Prior Publication Data

US 2010/0278552 A1 Nov. 4, 2010

(51) Int. Cl.
*G03G 21/00* (2006.01)
*G03G 15/095* (2006.01)

(52) U.S. Cl. ..... 399/98; 399/264

(58) Field of Classification Search ..... 399/98, 399/127, 264, 356
See application file for complete search history.

(56) References Cited

U.S. PATENT DOCUMENTS

| | | | | | |
|---|---|---|---|---|---|
| 5,363,183 | A * | 11/1994 | Reese et al. | ..... | 399/264 |
| 5,404,215 | A * | 4/1995 | Bares | ..... | 399/264 |
| 5,715,503 | A * | 2/1998 | Leone et al. | ..... | 399/264 |
| 5,752,138 | A * | 5/1998 | Wing et al. | ..... | 399/264 |
| 7,020,427 | B2 | 3/2006 | Hart | | |
| 7,142,798 | B2 * | 11/2006 | Martin | ..... | 399/264 |
| 7,415,221 | B2 | 8/2008 | Parisi et al. | | |

* cited by examiner

*Primary Examiner* — Sandra Brase
(74) *Attorney, Agent, or Firm* — Ronald E. Press, Jr.; Prass LLP

(57) ABSTRACT

A carrier bead collection assembly in a xerographic printer is disclosed. The carrier bead collection assembly may include a tray defining a cavity for retention of carrier beads, wherein the tray is located below a slot in a media transport surface in the xerographic printer and is removable so that it may be cleaned, and a magnet that is disposed beneath the tray, wherein the magnet attracts carrier beads that reside on the media transport surface such that as a result of the attraction, the carrier beads come to rest in the tray.

27 Claims, 3 Drawing Sheets

CARRIER BEAD COLLECTION ASSEMBLY FOR A XEROGRAPHIC PRINTER

BACKGROUND

Disclosed herein is a carrier bead collection assembly for a xerographic printer.

Carrier Beads are coarse, granular particles that along with a finely-divided, pigmented, powder referred to as toner, make up a developer mixture in a xerographic printer. The carrier beads are made or are coated with a material which is removed from the toner material in the triboelectric series so that when the two are mixed together to form the developer mixture, the toner particles are triboelectrically attracted to the carrier beads. The toner particles are small relative to the carrier beads and many toner particles are "carried" throughout the development system by each carrier bead.

As carrier beads fall into the paper path of a xerographic printer, they become attracted to the steel sheet metal parts in the paper transportation mechanism and may remain in place on the sheet metal for indefinite amounts of time. The carrier beads are made of steel or ferrite, are small in size, are typically less than 150 microns in diameter, and have irregular jagged surfaces. When the carrier beads remain on the paper transport, they scratch media sheets passing over them. For simplex runs, the backside of the print (unprinted) is damaged, whereas for duplex runs, the printed side 1 image is damaged, leaving obvious fine line scratch defects.

Sometimes the carrier beads are dragged or carried away by the media sheets; and sometimes they stay on the steel surface for long periods of time resulting in hundreds of defective prints. The problem has been temporarily amended by cleaning the surfaces of the steel transports after scratches are observed. This method is unreliable, temporary, and only addresses the problem after one or more media sheets have been damaged.

SUMMARY

A carrier bead collection assembly in a xerographic printer is disclosed. The carrier bead collection assembly may include a tray defining a cavity for retention of carrier beads, wherein the tray is located below a slot in a media transport surface in the xerographic printer and is removable so that it may be cleaned, and a magnet that is disposed beneath the tray, wherein the magnet attracts carrier beads that reside on the media transport surface such that as a result of the attraction, the carrier beads come to rest in the tray.

DETAILED DESCRIPTION

Figure 1:
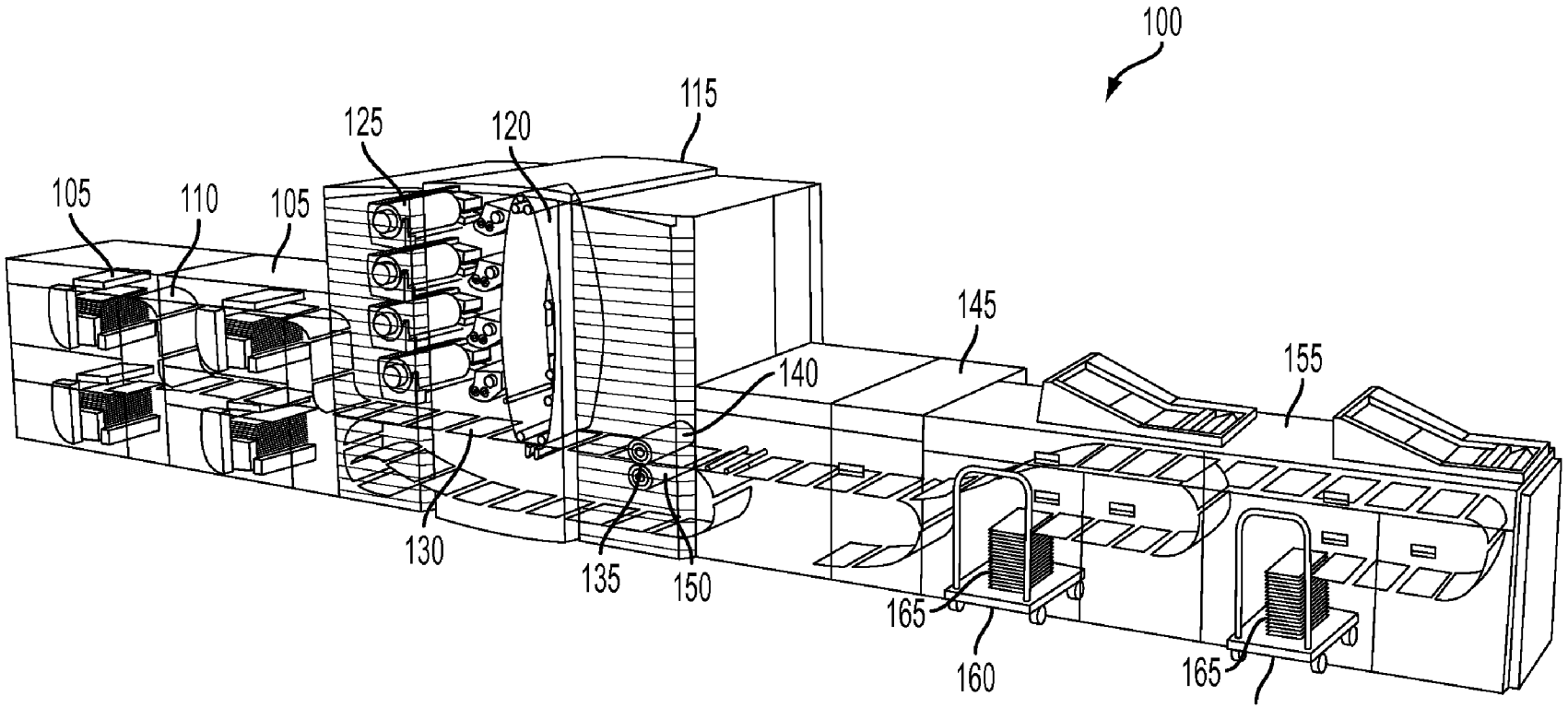
FIG. 1 is an exemplary diagram of a xerographic printer in accordance with one possible embodiment of the disclosure.

Aspects of the embodiments disclosed herein relate to a carrier bead collection assembly for a xerographic printer.

The disclosed embodiments may include a carrier bead collection assembly in a xerographic printer. The carrier bead collection assembly may include a tray defining a cavity for retention of carrier beads, wherein the tray is located below a slot in a media transport surface in the xerographic printer and is removable so that it may be cleaned, and a magnet that is disposed beneath the tray, wherein the magnet attracts carrier beads that reside on the media transport surface such that as a result of the attraction, the carrier beads come to rest in the tray.

The disclosed embodiments may further include a xerographic printer that may include a media transport section having a media transport surface that enables media sheets to be transported between sections of the xerographic printer, and a tray defining a cavity for retention of carrier beads, wherein the tray is located below a slot in the media transport surface in the xerographic printer and is removable so that it may be cleaned, and a magnet that is disposed beneath the tray, wherein the magnet attracts carrier beads that reside on the media transport surface such that as a result of the attraction, the carrier beads come to rest in the tray.

The disclosed embodiments may further include a media transport section having a media transport surface that transports media sheets between areas within a xerographic printer. The media transport section may include a tray a tray defining a cavity for retention of carrier beads, wherein the tray is located below a slot in the media transport surface in the xerographic printer and is removable so that it may be cleaned, and a magnet that is disposed beneath the tray, wherein the magnet attracts carrier beads that reside on the media transport surface such that as a result of the attraction, the carrier beads come to rest in the tray.

The disclosed embodiments may concern a carrier bead collection assembly for a xerographic printer. The carrier bead collection assembly may use the magnetic properties and the mass of the carrier beads to passively collect them in known regions of the paper path and then funnel the beads into locations where they could be cleaned off at regular intervals, which is chosen suitably to prevent defective prints. The carrier beads may fall onto the media transports and be magnetically attracted into slots in the steel surface of the transports. The slot depth is such that the beads may accumulate below the plane of the media sheets passing above them. Small sleeves may be placed under the slots which could be easily removed, cleaned, and re-installed.

The carrier bead collection assembly may include a tray made of metal, plastic, or other material, having about 1 mm wall thickness, for example. The length of the tray may extend slightly beyond the length of the cross-process paper direction, for example. The tray may be 2 to 4 mm deep with a strong magnet glued on the bottom surface. An example of a suitable magnet may be a rare earth sintered Neodymium 35, with magnetic strength of 1800 Gauss. The tray may be able to slide into a frame or rail to support it. The frame may include side rails to support the tray.

The carrier bead collection assembly may be placed anywhere in the paper path of the xerographic printer. Slots may be designed into the surface of the media transport wherever the carrier bead collection assembly would be installed.

The carrier bead collection assembly may be placed under the media transport surface so their active surface would be approximately 2 mm below the media transport surface. This spacing may allow enough room for carrier beads to collect out of the way of the paper moving above, and still be close enough to the steel surface to be effective.

The carrier bead collection assembly of the disclosed embodiments may allow for the carrier beads to be attracted down into the tray and not collect on the top of the steel media transport surface. The dimensions and the magnetic properties of the magnet as well as the width and depth of the tray are critical specifications that will drive the critical parameter of carrier bead attraction down into the tray. Lab experiments have shown that the carrier beads will be attracted toward a magnet from at least 25 mm away on the steel surface within 24 hours.

FIG. 1 is an exemplary diagram of a xerographic printer 100 in accordance with one possible embodiment of the disclosure. The xerographic printer 100 may be any device that may be capable of making image production documents (e.g., printed documents, copies, etc.) through a xerographic process, including a copier, a printer, a facsimile device, and a multi-function device (MFD), for example.

The xerographic printer 100 may include two media feeder modules 105 arranged in series, an image production module 115 adjacent the media feeding modules 105, an inverter module 145 adjacent the image production module 115, a media transport section, 130, and two stacker modules 155 arranged in series adjacent the inverter module 145. In the xerographic printer 100, the media feeder modules 105 feed media to the image production module 115.

In the image production module 115, toner is transferred from a series of developer stations 125 to a charged photoreceptor belt 120 to form toner images on the photoreceptor belt 120 and produce toner images. The toner images are transferred to respective media 110 fed through the paper path. The media sheets may be advanced through a fuser 135 including a fuser roll 140 and pressure roll 150, which form a nip where heat and pressure are applied to the media to fuse toner images onto the media.

The inverter module 145 may manipulate media exiting the image production module 115 by either passing the media through to the stacker modules 155, or inverting and returning the media to the image production module 115. In the stacker modules 155, the printed media sheets may be loaded onto stacker carts 160 to from media stacks 165.

The stacker module 155 may include finishing hardware for stacking, folding, stapling, binding, etc., prints which are output from the image production module 115. The xerographic printer 100 may also include a local user interface (not shown) for controlling its operations, although another source of image data and instructions may include any number of computers to which the printer is connected via a network.

Figure 2:
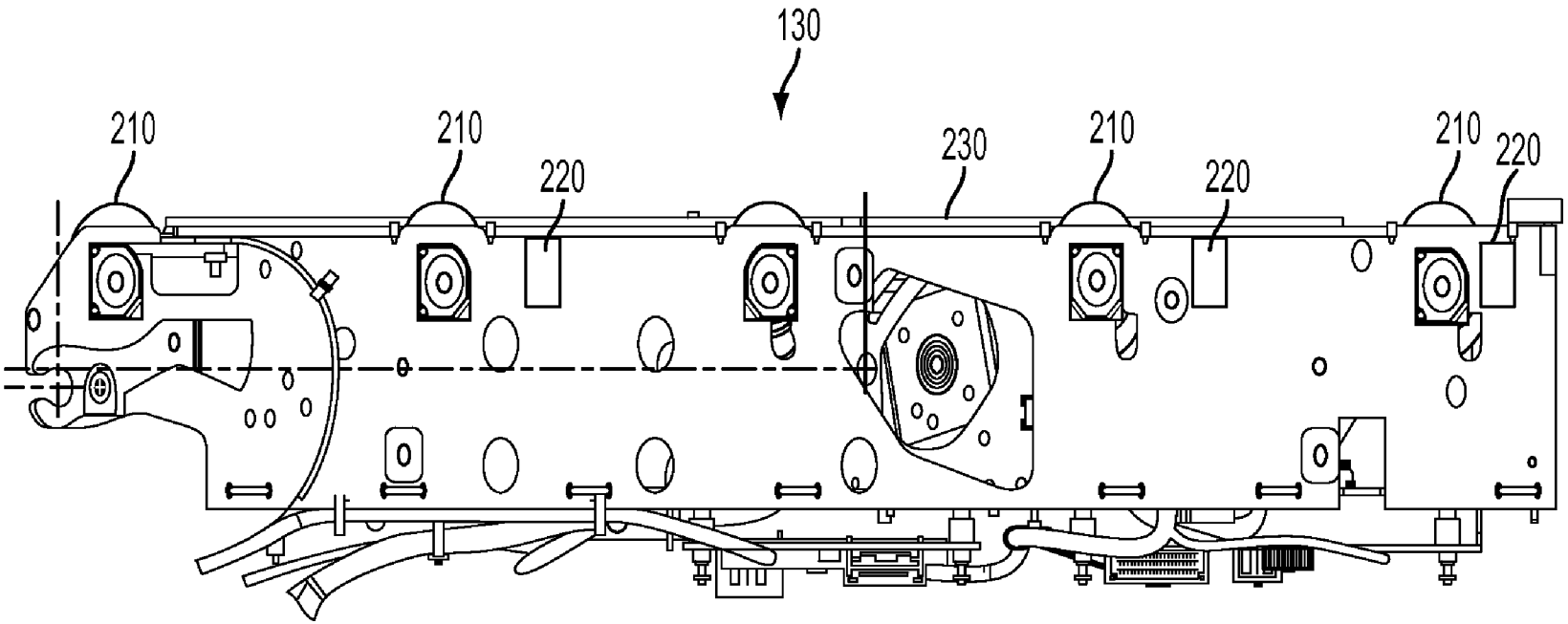
FIG. 2 is an exemplary diagram of carrier bead collection area (media transport section) in a paper path in the xerographic printer in accordance with one possible embodiment of the disclosure.

FIG. 2 is an exemplary diagram of carrier bead collection area in a paper path in the xerographic printer in accordance with one possible embodiment of the disclosure. In this example, the carrier bead collection area is the media transport section 130. However, there may be other carrier bead collection areas along the paper path in the xerographic printer 100 in accordance with the disclosed embodiments of the invention.

The media transport section 130 may include one or more nips 210 (the bottom roller portion being shown), a media transport surface 230, and one or more carrier bead collection assembly 220. The one or more nips 210 may include one or more rollers that may facilitate transporting media sheets through the media transport section 130. The media transport surface 230 may be made of metal (e.g., steel) or synthetic material and may provide a surface on which the media sheets may be transported to the inverter module 145. The one or more carrier bead collection assembly 220 may be located at one or more points along the media transport section 130 below the media transport surface 230. The one or more carrier bead collection assembly 220 will be described further in detail with respect to FIG. 3.

Figure 3:
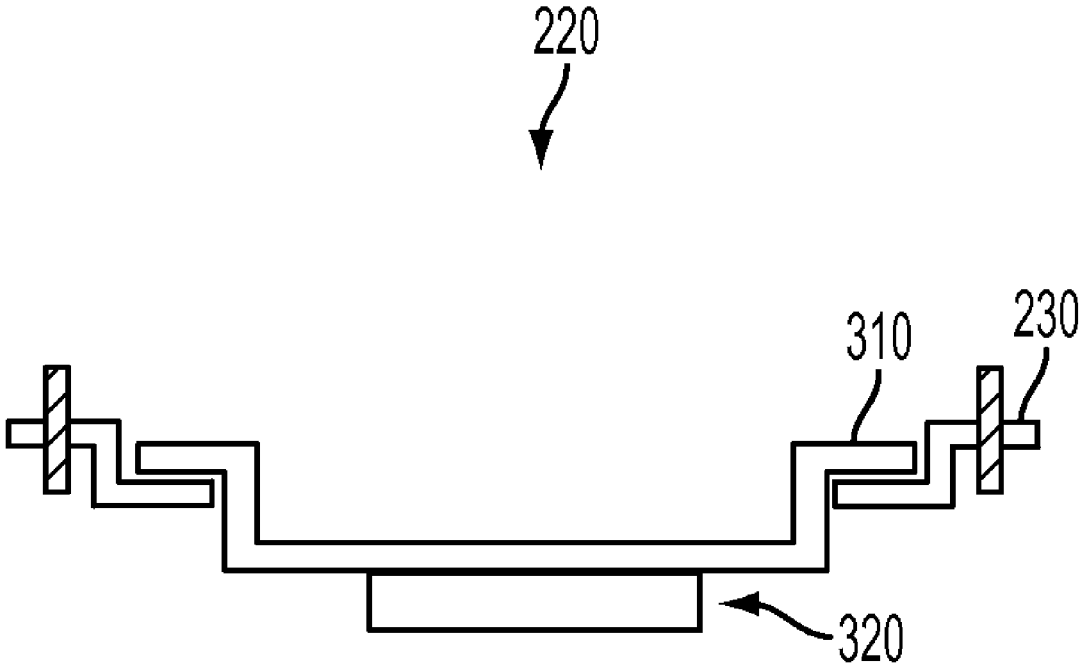
FIG. 3 is an exemplary diagram of the carrier bead collection assembly in accordance with one possible embodiment of the disclosure.

FIG. 3 is an exemplary diagram of the carrier bead collection assembly 220 in accordance with one possible embodiment of the disclosure. The carrier bead collection assembly 220 may include tray 310 which may rest upon a portion of media transport surface 230, and magnet 320 which is coupled to the bottom surface of tray 310. The tray 310 may be made of a non-ferrous metal, plastic, or other material, having approximately 1 mm wall thickness, for example. The length of the tray 310 may extend slightly beyond the length of the cross-process media direction, for example. The tray 310 may be 2 to 4 mm deep, 15-30 mm wide, and 14.30-14.35 inches long with the magnet 320 coupled to its bottom surface. The tray 310 may be defined as a cavity for collecting carrier beads and may be of any know shape that would hold carrier beads, such as unshaped, v-shaped, or semi-circular shaped.

The magnet 320 may be disposed beneath the tray in any manner known to one of skill in the art. For example, the magnet 320 may be attached to the tray 310, attached to the xerographic printer 100, or rest beneath the tray. The tray 310 may also comprise a magnet or magnetic surface. If the magnet 320 is attached to the tray. The magnet 320 may be coupled to the tray 310 in any fashion known one of skill in the art, including glued, taped, bracketed, riveted, nailed screwed, etc. An example of a suitable magnet may be a rare earth sintered Neodymium 35, with magnetic strength of 1800 Gauss, for example. However, any magnet 320 of any size or shape that may have the ability to attract carrier beads may be used.

The tray 310 may be able to slide into a frame or rail connected to the media transport section 130, the media transport surface 230, or other structure to support it beneath the surface of the media transport surface 230 so that it may be cleaned by a user or maintainer. The frame may include side rails to support the tray 310.

The carrier bead collection assembly 220 may be placed anywhere in the paper path of the xerographic printer 110. Slots may be designed into the surface of the media transport surface 230 wherever the carrier bead collection assembly 220 may be installed, for example.

The carrier bead collection assembly 220 may be placed under the media transport section 130 so that the active surface would be 1-3 mm below the media transport surface 230 (preferably approximately 2 mm). This spacing may allow enough room for carrier beads to collect out of the way of the media moving above, and still be close enough to the media transport surface 230 to be effective. The carrier bead collection assembly 220 of the disclosed embodiments may allow for the carrier beads to be attracted down into the tray 310 and not collect on the top of the media transport surface 230.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A carrier bead collection assembly in a xerographic printer, comprising:

a tray defining a cavity for retention of carrier beads, wherein the tray is located below a slot in a media transport surface in the xerographic printer and is removable so that it may be cleaned; and a magnet that is disposed beneath the tray, wherein the magnet attracts carrier beads that reside on the media transport surface such that as a result of the attraction, the carrier beads come to rest in the tray.

2. The carrier bead collection assembly of claim 1, wherein the tray rests on a rail beneath the media transport surface such that it may slide out to be cleaned.

3. The carrier bead collection assembly of claim 1, wherein the tray is disposed 1-3 mm below the media transport surface.

4. The carrier bead collection assembly of claim 1, wherein the tray is 14.30-14.35 inches long.

5. The carrier bead collection assembly of claim 1, wherein the tray is 2-4 mm deep and 15-30 mm wide.

6. The carrier bead collection assembly of claim 1, wherein the magnet comprises a rare earth sintered neodymium 35.

7. The carrier bead collection assembly of claim 1, wherein the xerographic printer is one of a copier, a printer, a facsimile device, and a multi-function device.

8. The carrier bead collection assembly of claim 1, wherein the tray is one of u-shaped, v-shaped and semi-circular shaped.

9. The carrier bead collection assembly of claim 1, wherein the magnet is one of attached to the tray, attached to the xerographic printer, and rests beneath the tray.

10. A xerographic printer, comprising:

a media transport section having a media transport surface that enables media sheets to be transported between sections of the xerographic printer;

a tray defining a cavity for retention of carrier beads, wherein the tray is located below a slot in the media transport surface in the xerographic printer and is removable so that it may be cleaned; and a magnet that is disposed beneath the tray, wherein the magnet attracts carrier beads that reside on the media transport surface such that as a result of the attraction, the carrier beads come to rest in the tray.

11. The xerographic printer of claim 10, wherein the tray rests on a rail beneath the media transport surface such that it may slide out to be cleaned.

12. The xerographic printer of claim 10, wherein the tray is disposed 1-3 mm below the media transport surface.

13. The xerographic printer of claim 10, wherein the tray is 14.30-14.35 inches long.

14. The xerographic printer of claim 10, wherein the tray is 2-4 mm deep and 15-30 mm wide.

15. The xerographic printer of claim 10, wherein the magnet comprises a rare earth sintered neodymium 35.

16. The xerographic printer of claim 10, wherein the xerographic printer is one of a copier, a printer, a facsimile device, and a multi-function device.

17. The xerographic printer of claim 10, wherein the tray is one of u-shaped, v-shaped and semi-circular shaped.

18. The xerographic printer of claim 10, wherein the magnet is one of attached to the tray, attached to the xerographic printer, and rests beneath the tray.

19. A media transport section having a media transport surface that transports media sheets between areas within a xerographic printer, comprising:

a tray defining a cavity for retention of carrier beads, wherein the tray is located below a slot in the media transport surface in the xerographic printer and is removable so that it may be cleaned; and a magnet that is disposed beneath the tray, wherein the magnet attracts carrier beads that reside on the media transport surface such that as a result of the attraction, the carrier beads come to rest in the tray.

20. The media transport section of claim 19, wherein the tray rests on a rail beneath the media transport surface such that it may slide out to be cleaned.

21. The media transport section of claim 19, wherein the tray is disposed 1-3 mm below the media transport surface.

22. The media transport section of claim 19, wherein the tray is 14.30-14.35 inches long.

23. The media transport section of claim 19, wherein the tray is 2-4 mm deep and 15-30 mm wide.

24. The media transport section of claim 19, wherein the magnet comprises a rare earth sintered neodymium 35.

25. The media transport section of claim 19, wherein the xerographic printer is one of a copier, a printer, a facsimile device, and a multi-function device.

26. The media transport section of claim 19, wherein the tray is one of u-shaped, v-shaped and semi-circular shaped.

27. The media transport section of claim 19, wherein the magnet is one of attached to the tray, attached to the xerographic printer, and rests beneath the tray.

* * * * *